US006025104A

United States Patent [19]

Fuller et al.

[11] Patent Number: 6,025,104

[45] Date of Patent: Feb. 15, 2000

[54] TONER AND DEVELOPER COMPOSITIONS WITH POLYOXAZOLINE RESIN PARTICLES

[75] Inventors: Timothy J. Fuller, W. Henrietta; Ralph A. Mosher, Rochester, both of N.Y.

[73] Assignee: Xerox Corporation, Stamford, Conn.

[21] Appl. No.: 07/921,820

[22] Filed: Jul. 29, 1992

[51] Int. Cl.[7] ..... G03G 9/00

[52] U.S. Cl. ..... 430/109; 430/108; 430/110

[58] Field of Search ..... 430/106, 109, 430/110, 904, 106.6, 108

[56] References Cited

U.S. PATENT DOCUMENTS

| | | | |
|---|---|---|---|
| 4,298,672 | 11/1981 | Lu | 430/108 |
| 4,338,390 | 7/1982 | Lu | 430/106 |
| 4,339,518 | 7/1982 | Okamura et al. | 430/126 |
| 4,795,689 | 1/1989 | Matsubara et al. | 430/99 |
| 4,868,086 | 9/1989 | Ohtani et al. | 430/137 |
| 4,880,857 | 11/1989 | Mori et al. | 523/205 |
| 4,937,157 | 6/1990 | Haack et al. | 430/110 |
| 5,032,484 | 7/1991 | DeMejo et al. | 430/110 |
| 5,061,587 | 10/1991 | Tsubuko et al. | 430/109 |
| 5,166,026 | 11/1992 | Fuller et al. | 430/106 |

FOREIGN PATENT DOCUMENTS

| | | |
|---|---|---|
| 253078 | 2/1990 | Japan . |
| 4202345 | 7/1992 | Japan . |

OTHER PUBLICATIONS

English Translation of JP 4–202345.
English Translation of JP 2–53078.

*Primary Examiner*—Janet Baxter
*Assistant Examiner*—Rosemary Ashton
*Attorney, Agent, or Firm*—E. O. Palazzo

[57] ABSTRACT

A toner composition comprised of substituted polyoxazolines resin particles, pigment particles, and optional charge enhancing additives.

21 Claims, No Drawings

TONER AND DEVELOPER COMPOSITIONS WITH POLYOXAZOLINE RESIN PARTICLES

BACKGROUND OF THE INVENTION

The invention is generally directed to toner and developer compositions, and more specifically, the present invention is directed to developer and toner compositions containing certain resins and optional charge enhancing additives, which impart or assist in imparting a positive charge to the toner resin particles, and enable toners with rapid admix characteristics, stable triboelectric characteristics in embodiments, and wherein the fusing properties of the toner resin are relatively constant in embodiments. In embodiments, there are provided in accordance with the present invention toner compositions comprised of certain substituted polyoxazoline polymers as resin particles, and pigment particles. In one embodiment, the present invention is directed to toners comprised of substituted polyoxazoline polymers of the formulas illustrated herein, which polymers have excellent glass transition temperatures, and suitable molecular weights and pigment particles, like carbon black, magnetite, cyan, yellow, magenta, red, green, blue, and the like. The polymers selected in embodiments possess a glass transition temperature or a crystalline melting temperature of from about 55 to about 75° C., a melt fusing temperature of from about 180° F. to about 300° F., and a hot offset temperature of from about 230° F. to about 380° F. The fusing temperatures were determined using a Xerox Corporation 5028 silicone roll fuser operated at 3.1 inches per second with solid area prints (toner mass area is 1.1 to 1.3 milligrams/cm$^2$) to the crease 20 fix level relative to the Xerox Corporation 1075 crease fix standards. This test condition correlates to the minimum fix temperature at the 65 crease level obtained with a Xerox Corporation 1075 fuser operated at 11 inches per second. The crease test consists of folding a solid area print with between 1.1 and 1.3 milligram/cm$^2$ toner mass area onto itself (180° bend), and then the print is unfolded and the optical density of the toner in the region of the crease is measured and correlated in the Xerox Corporation 1075 machine. The toner compositions of the present invention in embodiments thereof maintain their triboelectric charging characteristics for an extended number of imaging cycles, exceeding, for example, 500,000. The toner and developer compositions of the present invention can be selected for electrophotographic, especially xerographic, imaging and printing processes, including color processes.

Developer and toner compositions, including those with charge enhancing additives, which impart a positive charge to the toner resin, are well known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchlorides, tetrafluoroborates, benzene sulfonates, and the like. In U.S. Pat. No. 4,221,856 there are disclosed electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. In these and other patents, the toner resin includes, for example, styrene acrylates, styrene methacrylates, styrene butadienes, polyesters, polyamides, and the like. Advantages of the toner resins of the present invention as compared, for example, to the aforementioned styrene methacrylates include a low melt fusing temperature (10 to 130° F. lower than Xerox Corporation 1075 toner with a styrene methacrylate resin), broad fusing latitudes (50 to 80° F. compared with 35° F. of a Xerox Corporation toner control 1075), hot roll fusing without the need for silicone fuser oil release agents, color compatibility toner jettability, and the potential for negative as well as positive toner tribocharging. Moreover, these resin materials can serve as additives to conventional toners to aid in effective fused toner release from fuser rolls and to promote toner charging.

Also, there are disclosed in U.S. Pat. No. 4,338,390, the disclosure of which is totally incorporated herein by reference, toner compositions comprised of styrene polymers, and containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with styrene polymers, resin particles and pigment particles, and as charge enhancing additives alkyl pyridinium compounds. Additionally, other documents disclosing positively charged toner compositions comprised of styrene polymers, pigments particles, and charge control additives include U.S. Pat. Nos. 3,944,493; 4,007,293; 4,079,014; 4,394,430 and 4,560,635 which illustrates a toner with a distearyl dimethyl ammonium methyl sulfate charge additive.

The following prior art, all U.S. patents, are mentioned: U.S. Pat. No. 4,812,381 which discloses toners and developers containing charge control agents comprising quaternary ammonium salts of the formula indicated, for example, in the Abstract of the Disclosure, wherein R is alkyl with from 12 to 18 carbon atoms, and the anion is a trifluoromethylsulfonate; a similar teaching is presented in U.S. Pat. Nos. 4,834,921; 4,490,455 which discloses toners with, for example, amine salt charge enhancing additives, reference the Abstract of the Disclosure for example, and wherein A is an anion including those derived from aromatic substituted sulfonic acids, such as benzene sulfonic acid, and the like, see column 3, beginning at line 33; U.S. Pat. No. 4,221,856 directed to toners with a quaternary ammonium compound wherein A is an anion such as sulfate, sulfonate, nitrate, borate, chlorate, and certain halogens, see the Abstract of the Disclosure; U.S. Pat. No. Reissue 32,883 (a reissue of U.S. Pat. No. 4,338,390) illustrates toners with sulfate and sulfonate charge additives, see the Abstract of the Disclosure, wherein $R_4$ is an alkylene, and the anion contains an $R_5$ which is a tolyl group, or an alkyl group of from 1 to 3 carbon atoms, and n is the number 3 or 4; U.S. Pat. No. 4,323,634 which discloses toners with charge additives of the formulas presented in column 3, providing that at least one of the R's is a long chain amido group, and X is a halide ion or an organo sulfur containing group; U.S. Pat. No. 4,326,019 relating to toners with long chain hydrazinium compounds, wherein the anion A can be a sulfate, sulfonate, phosphate, halide, nitrate, see the Abstract of the Disclosure for example; U.S. Pat. No. 4,752,550 which illustrates toners with inner salt charge additives, or mixtures of charge additives, see for example column 8; U.S. Pat. No. 4,684,596 which discloses toners with charge additives of the formula provided in column 3 wherein X can be a variety of anions such as trifluoromethane sulfonate, and U.S. Pat. Nos. 4,604,338; 4,792,513; 3,893,935; 4,826,749 and 4,604,338. The disclosures of each of the aforementioned patents are totally incorporated herein by reference.

Illustrated in U.S. Pat. No. 4,937,157, the disclosure of which is totally incorporated herein by reference, are toner compositions comprised of styrene acrylate, styrene methacrylate, styrene butadiene, polyester, and the like, resin particles, pigment, or dye, and tetraalkyl, wherein alkyl, for example, contains from 1 to about 30 carbon atoms, ammonium bisulfate charge enhancing additives such as distearyl dimethyl ammonium bisulfate, tetramethyl ammonium bisulfate, tetraethyl ammonium bisulfate, tetrabutyl ammonium bisulfate, and preferably dimethyl dialkyl ammonium bisulfate compounds where the dialkyl radicals contain from about 10 to about 30 carbon atoms, and more preferably dialkyl radicals with from about 14to about 22 carbon atoms, and the like.

Illustrative examples of known toner resins include polyamides, polyolefins, styrene acrylates, styrene methacrylates, styrene butadienes, crosslinked styrene polymers, polyamides, polyurethanes, vinyl resins, including homopolymers or copolymers of two or more vinyl monomers; and polyesters, such as those obtained from the polymeric esterification of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like. Specific examples of toner resins include styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers may be selected.

In a patentability search report, there were recited U.S. Pat. No. 4,880,857, wherein oxazoline groups in a toner are apparently disclosed, and also see column 6; U.S. Pat. Nos. 4,339,518 and 5,061,587.

SUMMARY OF THE INVENTION

It is an object of the present invention to provide toner and developer compositions with charge enhancing additives.

In another object of the present invention there are provided low melting toner compositions containing substituted polyoxazoline or linear polyethyleneimine polymers, which toners are useful for the development of electrostatic latent images including color images.

In yet another object of the present invention there are provided positively charged toner compositions containing the charge additives illustrated herein.

Another object of the present invention resides in providing toner compositions with mixtures of charge enhancing additives wherein one of the additives can be, for example, a quaternary ammonium hydrogen bisulfate, especially trialkyl ammonium hydrogen bisulfate, or a tetraalkyl ammonium sulfonate, such as dimethyl distearyl ammonium sulfonate.

Also, in another object of the present invention there are provided developer compositions with positively charged toner particles, carrier particles, and the charge enhancing additives illustrated herein, or mixtures of these additives with other known charge enhancing additives.

In yet a further object of the present invention there are provided positively charged toner compositions with desirable admix properties of 30 seconds to 60 seconds as determined by the charge spectrograph, and preferably about 15 seconds for example, and more preferably from between about 5 to about 14 seconds, and acceptable stable triboelectric charging characteristics of from about 10 to about 40 microcoulombs per gram.

Additionally, in a further object of the present invention there are provided positively charged magnetic toner compositions, and positively charged colored toner compositions containing therein, or thereon the charge enhancing additives illustrated herein.

Another object of the present invention resides in the formation of substantially humidity insensitive toners which will effectively enable the development of images in electrophotographic imaging apparatuses, which images have substantially no background deposits thereon, are substantially smudge proof or smudge resistant, and therefore are of excellent resolution, and such toner compositions can be selected for high speed electrophotographic, especially xerographic, apparatuses, that is those exceeding 70 copies per minute; and these toners possess acceptable glass transition temperatures, and excellent fuser release characteristics.

These and other objects of the present invention can be accomplished in embodiments thereof by providing toner compositions comprised of polyoxazoline resin particles, pigment particles, and charge enhancing additives. More specifically, the present invention in one embodiment is directed to toner compositions comprised of substituted polyoxazolines, linear polyethyleneimine polymers, or mixtures thereof of the following formulas $[—CH_2—CH_2—N(COCF_3)—]_n$; $[—CH_2—CH_2—N(COCH_2CF_3)—]_n$; $[—CH_2—CH_2—N(COCF_3)—CH_2—CH_2—N(COCH_3)]_n$; $[—CH_2—CH_2—N(CO(CH_2)_{16}CH_3)—]_n$; $[—CH_2—CH_2—N(SiMe_2OCH_2CF_3)—]_n$; $[—CH_2—CH_2—N(SiMe_2CH_2CF_3)—]_n$; $[—CH_2—CH_2—N(COCF_2CF_2CF_3)—]_n$; $[—CH_2—CH_2—N(COCH_2CF_2CF_2CF_3)—]_n$; wherein Me represents $CH_3$ and n is a number of from 10, preferably 15, to about 100.

Suitable toner resins include those of the formula $[—CH_2—CH_2—N(R)—]_n$ wherein R is trifluoroacetyl, trifluoropropenyl, acetyl, stearoyl, trialkylsilyl, or fluorinated alkyl, and n is between 15 and 100 and preferably between 30 and 50. The water-insoluble polymers and copolymers of the present invention are humidity insensitive. Poly(trifluoroacetylethyleneimine) has a Tg of 55.6° C., as determined by differential scanning calorimetry (DSC). Poly(stearoylethyleneimine) melts at 74.3° C. Other combinations of substituent groups are also expected to have similar glass transition and melting temperatures. The polyoxazolines and substituted polyethyleneimines have GPC or light scattering weight average molecular weights ($M_w$)

between 1,500 and 100,000 and preferably between 30,000 and 50,000 (GPC $M_w$) in embodiments.

Specific resins include poly(trifluoroacetylethyleneimine) (Tg 55.6° C.), poly(trifluoroacetyl-co-acetyl-ethyleneimine) (Tg 84.2° C.), poly(trifluoropropenylethyleneimine), poly (stearoylethyleneimine) (Tm 74.3° C.), poly(dimethyl-trifluoroethoxysilylethyleneimine), poly(dimethyl-trifluoroethylsilylethyleneimine), poly (heptafluorobutanoylethyleneimine), and the like. Polyethyleneimines and polyoxazolines can include those materials prepared with silyl, fatty acid salt perfluorinated acid substituent groups. Fatty acids include cetyl, stearyl, eicosenyl, and behenyl. Fluorinated acids include trifluoroacetyl, trifluorethyl, trifluoropropyl, trifluorobutyl, heptafluorobutyl, and the like. Silyl substituents include alkylsilyl like trimethylsilyl, trifluoroethoxypropyl dimethylsilyl, trifluoroethyldimethyl, and the like.

Specific toner polymers preferred in embodiments include those with DSC glass transition temperatures or crystalline melting temperatures between 40 and 100° C. and preferably between 50 and 75° C., such as poly (trifluoroacetylethyleneimine) (Tg 55.6° C.) and poly (stearoylethyleneimine) (Tm 74.3° C.).

The polymers of the present invention can be prepared by the cationic thermal polymerization of 2-substituted oxazolines, or alternatively, by derivatizing linear polyethyleneimine with, for example, acyl chlorides, anhydrides, chlorosilanes, and other reagents known to react with secondary amines and polyamines. Linear polyethyleneimine can be prepared by the basic or preferably the acidic hydrolysis of poly(2-substituted-oxazolines), like poly(2-methyl-oxazoline), poly(2-ethyl-2-oxazoline) or poly(2-phenyl-2-oxazoline). Poly(trifluoroacetylethyleneimine) can be prepared by the thermal cationic polymerization of 2-trifluoromethyl-2-oxazoline or by the reaction of linear polyethyleneimine with either trifluoroacetic anhydride or trifluoroacetyl chloride.

Embodiments of the present invention include a toner composition comprised of substituted polyoxazolines and/or substituted linear polyethyleneimines, pigment particles, and optional charge enhancing additives; a toner composition comprised of substituted polyoxazolines and substituted linear polyethyleneimines of the following formulas $[—CH_2—CH_2—N(COCF_3)—]_n$; $[—CH_2—CH_2—N(COCH_2CF_3)—]_n$; $[—CH_2—CH_2—N(COCF_3)—CH_2—CH_2—N(COCH_3)]_n$; $[—CH_2—CH_2—N(CO(CH_2)_{16}CH_3)—]_n$; $[—CH_2—CH_2—N(SiMe_2OCH_2CF_3)—]_n$; $[—CH_2—CH_2—N(SiMe_2CH_2CF_3)—]_n$; $[—CH_2—CH_2—N(COCF_2CF_2CF_3)—]_n$; or $[—CH_2—CH_2—N(COCH_2CF_2CF_2CF_3)—]_n$, pigment particles, and optional charge enhancing additives, and wherein Me is methyl and n is a number of from about 15 to about 100; and a toner wherein the polyoxazolines and substituted linear polyethyleneimines include those represented by the formula $[—CH_2—CH_2—N(R)—]_n$ wherein R is trifluoroacetyl, trifluoropropenyl, trifluoroacetyl/acetyl, stearoyl, trialkylsilyl, fluorinated alkyl, or fluorinated alkyl substituents, and n is between 15 and 100.

The toner compositions of the present invention can be prepared by a number of known methods, such as admixing and heating the polyoxazoline polymers, pigment particles such as magnetite, carbon black, like REGAL 330®, or mixtures thereof, and preferably from about 0.5 percent to about 5 percent of the aforementioned charge enhancing additive, or mixtures of charge additives, in a toner extrusion device, such as the ZSK53 extruder available from Werner Pfleiderer, and removing the formed toner composition from the device. Subsequent to cooling, such as cooling in air or water, the toner composition is subjected to grinding utilizing, for example, a Sturtevant micronizer for the purpose of achieving toner particles with a volume median diameter of less than about 25 microns, and preferably of from between about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Also, waxes with a molecular weight of from about 500 to about 20,000, such as polyethylene, polypropylene, and paraffin waxes can be included in, or on the toner compositions as fuser roll release agents. These waxes are usually present in effective amounts of, for example, from between about 1 to about 10 weight percent.

The polyoxazolines and substituted polyethyleneimines are present in a sufficient, but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of polymer is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent. Less than 70 weight percent of the polyoxazolines or substituted polyethyleneimines can be used in toner blends with conventional toner materials when these additives are intended to improve release of toner from fuser rolls or when specific tribocharging effects are desired.

Numerous well known suitable pigments or dyes can be selected as the colorant for the toner particles including, for example, carbon black, like REGAL 330®, nigrosine dye, aniline blue, magnetite, or mixtures thereof. The pigment can be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles may be selected.

When the pigment particles are comprised of magnetites, thereby enabling, for example, single component toners, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL® like AEROSIL R972®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL® like AEROSIL R972®, can be surface treated with the charge additives illustrated herein in an amount of from about 1 to about 30 weight percent, and preferably 10 weight percent followed by the addition thereof to the toner in an amount of from 0.1 to 10 and preferably 0.1 to 1 weight percent.

Also, there can be included in the toner compositions of the present invention, as indicated herein, low molecular weight waxes, such as polypropylenes and polyethylenes commercially available from Allied Chemical and Petrolite Corporation, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected have, it is believed, a molecular weight of from about 1,000 to about 1,500, while the commercially available polypropylenes utilized for the toner compositions of the present invention are believed to have a molecular weight of from about 4,000 to about 7,000. Many of the polyethylene and polypropylene compositions useful in the present invention are illustrated in British Patent 1,442,835, the disclosure of which is totally incorporated herein by reference.

The low molecular weight wax materials are present in the toner compositions of the present invention in various amounts, however, generally these waxes are present in the toner composition in an amount of from about 1 percent by weight to about 15 percent by weight, and preferably in an amount of from about 2 percent by weight to about 10 percent by weight.

Further encompassed within the scope of the present invention are colored toner and developer compositions comprised of toner resin particles, optional carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles can be selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, especially a polymeric coating, the coating generally being comprised of terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black like VULCAN® carbon black available from Cabot Corporation, in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 500, and preferably about 175 microns thereby permitting them to possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier.

The toner composition of the present invention can be prepared by a number of known methods as indicated herein including extrusion, melt blending the toner polymer particles, pigment particles or colorants, and charge enhancing additives as indicated herein, followed by mechanical attrition and optional classification to provide toner particles with an average diameter of from between about 7 to about 25 microns. Other methods include those well known in the art such as spray drying, melt dispersion, extrusion processing, dispersion polymerization, and suspension polymerization. Also, the toner composition without the charge enhancing additive can be prepared, followed by the addition thereof to colloidal silicas. More specifically, the toner compositions of the present invention can be prepared by a number of known methods, such as admixing and heating the substituted polyoxazolines, pigment particles such as magnetite, carbon black, or mixtures thereof, and preferably from about 0.5 percent to about 5 percent of the charge enhancing additive, or mixtures of charge additives, in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from between about 5 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Also, the toner compositions of the present invention in embodiments thereof possess desirable narrow charge distributions, optimal charging triboelectric values, preferably of from 10 to about 40, and more preferably from about 10 to about 35 microcoulombs per gram with from about 0.1 to about 5 weight percent in one embodiment of the charge enhancing additive.

When the polyoxazolines and substituted polyethyleneimines of the present invention are utilized in admixtures with other additives, for example alkyl pyridinium halides, organic sulfates, organic sulfonates, the bisulfates illustrated herein, distearyl dimethyl ammonium methyl sulfate, and the like, generally there is present in the mixture an effective amount of each additive, such as for example from about 30 to about 80 percent by weight of the first additive of the present invention, and from about 20 to about 70 weight percent of the second charge additive in an embodiment of the present invention, from about 40 to about 60 percent by weight of the first additive, and from about 60 to about 40 weight percent of the second charge additive in another embodiment of the present invention.

The following Examples are being provided to further define various species of the present invention, it being noted that these Examples are intended to illustrate and not limit the scope of the present invention. Parts and percentages are by weight unless otherwise indicated. Comparative Examples are also provided.

EXAMPLE I

Preparation of 2-Phenyl-2-Oxazoline:

Ethanolamine (304 grams) was added over 90 minutes to a stirred suspension of cadmium acetate dihydrate (16.5 grams) in benzonitrile (512 grams) at 130° C. in a 1 liter flask. After 16 hours of continued stirring, distillation provided a clear fraction of 2-phenyl-2-oxazoline boiling over at 82° C. and 1.5 millimeters mercury, which fraction was collected and identified by infrared spectroscopy and $^{1}$H and $^{13}$C NMR spectrometry.

EXAMPLE II

Preparation of 2-Phenyl-2-Oxazolium Perchlorate:

Perchloric acid (19.5 grams) was added to 2-phenyl-2-oxazoline (20 grams) in water (20 milliliters) and ethanol (20 milliliters). The resultant solution was cooled at −20° C. in a 250 milliliter Erlenmeyer flask. White crystals of 2-phenyl-2-oxazolium perchlorate, identified by infrared spectroscopy and $^{1}$H and $^{13}$C NMR spectrometry, were isolated by filtration and dried in vacuo at 30° C.

EXAMPLE III

Polymerization of 2-Phenyl-2-Oxazoline:

2-Phenyl-2-oxazolium perchlorate (0.52 gram) and 2-phenyl-2-oxazoline (100 grams) were heated to 1 50° C. in a 500 milliliter flask situated in an oil bath with stirring under argon. The mixture became too thick to stir within 1 hour. The light yellow solid formed is poly(2-phenyl-2-oxazoline), as identified by infrared spectroscopy and $^{1}$H and $^{13}$C NMR spectrometry.

EXAMPLE IV

Hydrolysis of Poly(2-Phenyl-2-Oxazoline) to Form Linear Polyethyleneimine:

Poly(2-phenyl-2-oxazoline) (70.4 grams) was heated at reflux with 710 milliliters of concentrated hydrochloric acid in water (540 milliliters) for 5 days in a 1 liter flask equipped with a mechanical stirrer and reflux condenser and situated in a 120° C. silicone oil bath. The mixture was taken to dryness using a rotary evaporator, and then water (800 milliliters) was added. Benzoic acid, as white needles, was removed by filtration. The filtrate was made alkaline by the addition of 50 weight percent of sodium hydroxide. The polyethyleneimine that precipitated was collected by filtration, washed with water until neutral, and then dissolved in hot ethanol (300 milliliters). Linear polyethyleneimine that precipitated on cooling to 25° C. was isolated by filtration, dried in vacuo, and then identified by infrared spectroscopy and $^{1}$H and $^{13}$C NMR spectrometry.

EXAMPLE V

Polymerization of 2-Ethyl-2-Oxazoline:

2-Ethyl-2-oxazoline (163 grams) and 2-phenyl-2-oxazolium perchlorate (1.22 grams) were heated in a crimped 12 ounce aluminum can at 95° C. in an oil bath. Polymerization took place vigorously within 1.5 hours. The resultant light yellow solid, poly(2-ethyl-2-oxazoline), was peeled from the can and pulverized using a Waring blender to form a powder which could be more easily dissolved. The Tg of the polyethyloxazoline was 56° C. (as determined with DSC), and product characterization was accomplished using infrared spectroscopy and $^{1}$H and $^{3}$C NMR spectrometry.

EXAMPLE VI

Hydrolysis of Poly(2-Ethyl-2-Oxazoline) to Form Linear Polyethyleneimine:

Poly(2-ethyl-2-oxazoline) (96 grams) in 111 milliliters of concentrated hydrochloric acid and 889 milliliters of water was heated at 150° C. in an oil bath. Propionic acid distillate was removed with a Claisen take-off distillation head until only a solid yellow residue remained. Another 222 milliliters of water and 28 milliliters of concentrated hydrochloric acid was added. Distillation was continued until dryness. The resulting residue was dissolved in water and treated at 25° C. with 50 weight percent of sodium hydroxide until a pH of 14 was achieved. The linear polyethyleneimine that precipitated was isolated by filtration and washed until the pH of the aqueous polymer suspension was between 7 and 8. The white polymer was filtered off and then dried to provide linear polyethyleneimine with no detectable $^{13}$C NMR carbonyl resonance in high yield. The product has a 60° C. melting peak endotherm (as determined with DSC).

EXAMPLE VII

Hydrolysis of Poly(2-Ethyl-2-Oxazoline), Dow PEOX-50, to Form Linear Polyethyleneimine:

To a 3-neck, 1 liter flask equipped with a mechanical stirrer, Claisen distillation take-off head and a reflux condenser, was added PEOX-50™ (Dow, 100 grams, polyethyloxazoline—50,000 $M_w$) in 890 milliliters of water and 111 milliliters of concentrated hydrochloric acid. The solution was heated in a 150° C. oil bath, and the propionic acid and water that formed were removed by distillation until only a solid residue remained. The resultant solid dissolved in water was treated with 50 weight percent of sodium hydroxide until a pH of 14 was achieved. The precipitated polyethyleneimine that formed was isolated by filtration and washed until the aqueous polymer suspension was between a pH 7 and 8. The white polymer was filtered off and then vacuum dried to provide linear polyethyleneimine with a DSC crystalline melting temperature at 60° C. No carbonyl resonance was detected in the $^{13}C$ NMR spectrum of the product.

EXAMPLE VIII

Preparation of Poly(Trifluoroacetylethyleneimine):

A three-neck, 3 liter flask was equipped with a mechanical stirrer, addition funnel, and water condenser. Linear polyethyleneimine (20 grams, 23780-30) with a GPC peak molecular weight of 30,000 and $M_w/M_n$=3, and THF (1 liter) were added. The polymer dissolved on heating at reflux using an oil bath. Sodium trifluoroacetate (68 grams) was rapidly added, and then trifluoroacetic anhydride (110 grams) was added slowly with an addition funnel. The oil bath was removed and the anhydride was added at a rate sufficient to maintain reflux. After complete anhydride addition, the solution was heated at reflux for 2.5 hours. The reaction solution at 25° C. was then added to water (2 liters), and the polymer that precipitated was filtered, washed until the washings were of a pH of 7, and then vacuum dried. Poly(trifluoroacetylethyleneimine) was identified using infrared spectroscopy and $^{1}H$ and $^{13}C$ NMR spectrometry, and was obtained in 96.4 percent yield (62.3 grams). The polymer Tg was 55.6° C. (as measured with DSC).

Toner Preparation:

Poly(trifluoroacetylethyleneimine (20 grams) was formulated into a toner by extrusion using a CSI mixing extruder at 130° C. with 6 weight percent of REGAL 330® carbon black and 2 weight percent of TP-302™ (Nachem), followed by micronization of the extrudate using a TROST GEM T™ jet mill (Garlock). The toner was determined to be 8 microns (number average) by Laysen cell particle size analysis. When mixed at 3 weight percent with 70:30 KYNAR®:polymethyl methacrylate coated ferrite carrier, the triboelectric charge on the toner was +15 microcoulombs per gram as measured with a Faraday Cage apparatus after 1 hour on a roll mill operated at 100 revolutions per minute. The toner fused at 300° F. (minimum fix temperature at 65 crease fix level according to the Xerox Corporation 1075 toner fix standards) and the hot offset temperature was 380° F. using a Xerox 5028 silicone soft roll fuser operated at 3.1 inches per second. This compares with a minimum fix temperature of 310° F. for the Xerox Corporation 1075 toner, formulated with suspension polymerized styrene-43 weight percent-n-butyl methacrylate copolymer, 6 weight percent of REGAL 330® and 2 weight percent of cetyl pyridinium chloride, and fused under the same conditions. By comparison, the hot offset temperature (the temperature where fused molten toner images offset to the fuser roll and then onto paper images) was 340° F. for the Xerox Corporation 1075 toner. No silicone oil release agent was used on the fuser roll. The improved offset performance of the fluorinated toner has been attributed to improved surface tension of the fluorinated toner compared with that of the Xerox Corporation 1075 toner.

The poly(trifluoroacetylethyleneimine) can be selected for toner applications where no or low silicone fuser oil release agent management is desired.

EXAMPLE IX

Preparation of Polyethyleneimine with Acetyl- and Trifluoroacetyl-Co-Substituent Groups:

A 2 liter, 3-neck flask was equipped with a mechanical stirrer, reflux condenser and addition funnel. Linear polyethyleneimine (23780-30, 18.9 grams) and tetrahydrofuran (600 milliliters) were added and the mixture was heated at reflux to dissolve the polymer. Sodium trifluoroacetate (61.2 grams) was added. Trifluoroacetic anhydride (47.2 grams) was then added slowly with the addition funnel. After complete addition, the mixture was heated 1.5 hours at reflux. Sodium acetate (18.45 grams) was added and then acetic anhydride (22.95 grams) was slowly added with the addition funnel. The reaction mixture was stirred at reflux for 2 hours and then cooled to 25° C. The mixture was then poured into water (2 liters) and the polymeric product precipitated. The polymer was isolated by filtration, washed extensively with water, and then vacuum dried. The yield of water insoluble polymer was 13.2 grams. The Tg was 84.2° C. as determined by DSC. Product characterization was accomplished using infrared spectroscopy and $^{1}H$ and $^{13}C$ NMR spectrometry. Xerographic toner was then prepared by repeating the process of Example VIII with 6 weight percent of REGAL 330® and 94 percent by weight of the above polymer, and evaluated as in Example I. The minimum fix temperature of the resultant toner was 380° F. The high fusing temperature of this material is attributed to the high Tg of the toner resin. Excellent fusing results are achieved when the toner resin has a Tg near 50° C. A Tg value of 50° C. or above is usually desired for environmental toner blocking tests, thus materials with Tg values lower than 50° C. are not as effective for use in toners even though better toner fusing results as may be obtained with these materials.

EXAMPLE X

Preparation of Poly(Stearoylethyleneimine):

A 1 liter, 3-neck flask equipped with a mechanical stirrer, reflux condenser and addition funnel was situated in an oil bath. Linear polyethyleneimine (10.7 grams) and chloroform (300 milliliters) were added. After boiling at reflux to dissolve the polymer, the reaction vessel was situated in an ice bath and triethylamine (30 milliliters) was added to the cold polymer suspension. Stearoyl chloride (90 milliliters) in chloroform (100 milliliters) was added slowly over 20 minutes with an exotherm evident. After complete addition, the reaction mixture was boiled at reflux for 5 hours. After stirring 12 hours at 25° C., the reaction was added to water (2 liters) and the chloroform layer was separated, dried over potassium carbonate, filtered, and then evaporated using a rotary evaporator. The resultant polymeric residue was poly (stearoylethyleneimine) and consisted of tetrahydrofuran soluble and insoluble portions, both of which were spectroscopically and thermally identical. The crystalline THF soluble product had a DSC melting point at 74.3° C. Product characterization was accomplished using infrared spectroscopy and $^{1}H$ and $^{13}C$ NMR spectrometry. When a toner was prepared by repeating the process of Example VIII with 6 weight percent of REGAL 330®, 2 weight percent of the charge additive TP-302™ (Nachem), and 92 weight percent of the above polymer, and then evaluated as in Example I, the toner had a minimum fix temperature at 180° F. and evidenced a hot offset temperature at 230° F.

Advantages of the toner resins of the present invention as compared to the aforementioned styrene methacrylates include low melt fusing temperature (10 to 130° F. lower than 1075 toner), broad fusing latitudes (50 to 80° F. compared with 35° F. of the 1075 control), hot roll fusing without the need for silicone fuser oil release agent, color compatibility, toner jettability, and the potential for negative as well as positive toner tribocharging. Moreover, the resin materials of the present invention can serve as additives to conventional toners to aid in effective fused toner release from fuser rolls and to promote toner charging.

Other modifications of the present invention may occur to those skilled in the art subsequent to a review of the present application, and these modifications, including equivalents thereof, are intended to be included within the scope of the present invention.

What is claimed is:

1. A toner composition consisting of resin particles, pigment particles, and optional charge enhancing additives, and wherein said resin particles are of the formula $(—CH_2—CH_2—N(R)—)_n$ wherein R is trifluoroacetyl, trifluoropropenyl, trifluoroacetyl/acetyl, stearoyl, trialkylsilyl, fluorinated alkyl or fluorinated alkyl substituents, and n is between 15 and 100.

2. A toner composition in accordance with claim 1 wherein the molecular weight of said resin particles is between 1,500 and 100,000 or between 30,000 and 50,000 $M_w$ as determined by gel permeation chromatography or light scattering.

3. A toner composition in accordance with claim 1 wherein the resin particles function as charge control agents and as fuser release agent management additives.

4. A toner composition in accordance with claim 1 wherein said resin particles and the charge additive are present in an amount of from about 0.05 to about 5 weight percent.

5. A toner composition in accordance with claim 1 wherein the charge additive is incorporated into the toner.

6. A toner composition in accordance with claim 1 wherein the charge additive is present on the surface of the toner composition.

7. A toner composition in accordance with claim 1 with a positive or negative triboelectric charge of from about 10 to about 40 microcoulombs per gram.

8. A toner composition in accordance with claim 1 containing a wax component with a weight average molecular weight of from about 500 to about 7,000.

9. A toner composition in accordance with claim 8 wherein the wax component is selected from the group consisting of polyethylene, polypropylene, and mixtures thereof.

10. A toner composition in accordance with claim 1 containing as external additives metal salts of a fatty acid, colloidal silicas, or mixtures thereof.

11. A toner composition in accordance with claim 1 wherein the pigment particles are carbon black, magnetites, or mixtures thereof, cyan, magenta, yellow, red, blue, green, brown, or mixtures thereof.

12. A developer composition comprised of the toner composition of claim 1 and carrier particles.

13. A developer composition in accordance with claim 12 wherein the carrier particles are comprised of ferrites, steel, or an iron powder.

14. A developer composition in accordance with claim 12 wherein the carrier particles are comprised of a core with a polymer coating thereover.

15. A developer composition in accordance with claim 12 wherein the coating is comprised of a methyl terpolymer, a polyvinylidine fluoride, a polymethyl methacrylate, a mixture of polymers not in close proximity in the triboelectric series, or a silicone resin.

16. A method of imaging which comprises formulating an electrostatic latent image on a photoconductive imaging member, affecting development thereof with the toner composition of claim 1, and thereafter transferring the developed image to a suitable substrate.

17. A toner composition in accordance with claim 1 wherein said resin particles are of the formulas $[—CH_2—CH_2—N(COCF_3)—]_n$; $[—CH_2—CH_2—N(COCH_2CF_3)—]_n$; $[—CH_2—CH_2—N(COCF_3)—CH_2—CH_2—N(COCH_3)]_n$; and wherein n is a number of from about 15 to about 100.

18. A toner composition in accordance with claim 1 wherein n is a number of from about 30 to about 50.

19. A toner composition in accordance with claim 1 wherein said resin particles are polyoxazolines.

20. A toner composition consisting essentially of resin particles of the formulas $[—CH_2—CH_2—N(COCF_3)—]_n$; $[—CH_2—CH_2—N(COCH_2CF_3)—]_n$; $[—CH_2—CH_2—N(COCF_3)—CH_2—CH_2—N(COCH_3)]_n$; $[—CH_2—CH_2—N(CO(CH_2)_{16}CH_3)—]_n$; $[—CH_2—CH_2—N(SiMe_2OCH_2CF_3)—]_n$; $[—CH_2—CH_2—N(SiMe_2CH_2CF_3)—]_n$; $[—CH_2—CH_2—N(COCF_2CF_2CF_3)—]_n$; or $[—CH_2—CH_2—N(COCH_2CF_2CF_2CF_3)—]_n$, pigment particles, and optional charge enhancing additives; and wherein Me is $CH_3$ and n is a number of from about 15 to about 100.

21. A toner in accordance with claim 20 wherein said resin particles are polyoxazolines.

* * * * *